US006533051B1

(12) United States Patent
Singh et al.

(10) Patent No.: US 6,533,051 B1
(45) Date of Patent: Mar. 18, 2003

(54) ROLLER CONE DRILL BIT SHALE DIVERTER

(75) Inventors: Amardeep Singh, Houston, TX (US); Dennis Cisneros, Kingwood, TX (US); Sujian J. Huang, The Woodlands, TX (US); Quan V. Nguyen, Houston, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/390,717

(22) Filed: Sep. 7, 1999

(51) Int. Cl.[7] ..... E21B 10/22
(52) U.S. Cl. ..... 175/371; 175/365
(58) Field of Search ..... 175/331, 365, 175/371, 372

(56) References Cited

U.S. PATENT DOCUMENTS

| | | | | |
|---|---|---|---|---|
| 4,431,066 A | | 2/1984 | Cunningham et al. | 175/372 |
| 4,822,057 A | * | 4/1989 | Chia et al. | 277/84 |
| 5,056,610 A | | 10/1991 | Oliver et al. | 175/371 |
| 5,358,061 A | | 10/1994 | Van Nguyen | 175/371 |
| 5,570,750 A | * | 11/1996 | Williams | 175/371 |
| 5,740,871 A | * | 4/1998 | Williams | 175/371 |
| 6,026,917 A | * | 2/2000 | Zahradnik et al. | 175/371 |
| 6,033,117 A | * | 3/2000 | Cariveau et al. | 384/94 |

FOREIGN PATENT DOCUMENTS

| | | |
|---|---|---|
| GB | 338146 | 6/1929 |
| GB | 352240 | 6/1930 |
| GB | 444712 | 9/1934 |
| GB | 457403 | 8/1935 |
| GB | 2 283 037 A | 4/1995 |
| WO | WO 80/00265 A1 | 2/1980 |

OTHER PUBLICATIONS

Hughes Christensen brochure (a Baker Hughes company) entitled "Ultra Max High Performance Bits for Motor and High Speed Applications", dated 1998.
Great Britain Search Report, dated Dec. 12, 2002, 2 pages.
PCT International Search Report, Oct. 20, 2000, 2 pages.

* cited by examiner

*Primary Examiner*—David Bagnell
*Assistant Examiner*—Jennifer H Gay
(74) *Attorney, Agent, or Firm*—Rosenthal & Osha L.L.P.

(57) ABSTRACT

A roller cone drill bit includes a bit body adapted to be rotated about a longitudinal axis. At least one leg which terminates in a shirttail portion depends from the bit body. The shirttail portion defines a first end face having a first circumferential groove thereon. The first circumferential groove has a radius equal to the radius of a tip of the shirttail portion. A journal is cantilevered from the leg, and a roller cone is rotatably mounted on the journal. The roller cone has a second end face adjacent to the first end face. A second circumferential groove is formed on the second end face.

6 Claims, 9 Drawing Sheets

ROLLER CONE DRILL BIT SHALE DIVERTER

BACKGROUND OF THE INVENTION

1. Technical Field

The invention relates generally to roller cone drill bits. More particularly, the invention relates to a means for diverting shale or other debris from the drill bit during operation.

2. Background Art

Roller cone drill bits typically include a main body with a threaded pin formed on the upper end of the main body for connecting to a drill string, and one or more legs depending from the lower end of the main body. FIG. 1 shows an example of a drill bit leg 2 which terminates in a "shirttail" portion 4. A journal 8 is cantilevered from an end face 6 of the leg 2. The journal 8 rotatably supports a roller cone 10. When the roller cone 10 is mounted on the journal 8, the end face 12 of the roller cone 8 is adjacent to the end face 6 of the leg 2. In some types of roller cone bits, a clearance 14 may be provided between the end faces 6 and 12 to prevent interference between the leg 2 and the roller cone 8 during operation of the drill bit. If provided in a particular bit, the clearance 14 is normally held to fairly close tolerance to help limit axial movement of the roller cone 10 on the journal 8. A seal 16 may be provided to retain lubricant between the mating surfaces 18 and 20 of the journal 8 and the roller cone 10, respectively, and to protect the lubricant from contaminants.

The main body of the drill bit has an internal chamber and a plurality of nozzles through which fluid received in the internal chamber is directed to the exterior of the main body. Ideally, the fluid flowing out of the nozzles would flush all debris away from the drill bit as the drill bit cuts the earth formation. However, debris tends to accumulate in the clearance between the adjacent end faces of the leg and the roller cone. Accumulation of debris in the clearance between the adjacent end faces of the leg and the roller cone is undesirable for at least two reasons. First, the relative motion between the roller cone and the leg can cause the accumulated debris to abrade the end faces of the leg and the roller cone. The end face of the leg is in a vulnerable section of the leg, i.e., the juncture between the leg and the journal. As a result, abrasion of the end face of the leg weakens the leg. Secondly, the accumulated debris can damage the seal which is intended to protect the mating surfaces of the journal and the roller cone from debris and other contaminants.

Solutions to the problem of debris accumulation in the clearance between the end faces of the leg and the roller cone are not new. U.S. Pat. No. 5,056,610 to Oliver et al, for example, discloses a solution to the debris accumulation problem which includes providing a "burn plug" which has a debris diverting ridge formed in its face. The burn plug is secured in an aperture in the end face of the leg and oriented such that the diverting ridge deflects debris away from the clearance between the end faces of the leg and the roller cone. The burn plug is energized to urge its ridged face against the end face of the roller cone. U.S. Pat. No. 5,358,061 to Van Nguyen discloses a different solution to the debris accumulation problem, which includes providing a hard metal scraper pad to wipe debris off the end face of the roller cone. The hard metal scraper pad is mounted across a trailing end of a circumferential groove on the end face of the leg. In another debris diverter system, a combination of a mud wiper on the end face of the leg which cooperates with a groove in the end face of the roller cone is used to control accumulation of debris in the clearance between the end faces of the leg and the roller cone.

SUMMARY OF THE INVENTION

One aspect of the invention is a roller cone drill bit which comprises a bit body that is adapted to be rotated about a longitudinal axis. The bit body has at least one leg depending therefrom. The leg terminates in a shirttail portion. The shirttail portion defines a first end face. A first circumferential groove formed on the first end face has a radius equal to the radius of a tip of the shirttail portion. A journal is cantilevered from the leg. A roller cone is rotatably mounted on the journal. The roller cone has a second end face adjacent to the first end face. A second circumferential groove is formed on the second end face. The second circumferential groove has a radius which matches the radii of the shirttail tip and the first circumferential groove.

Another aspect of the invention is a roller cone drill bit including a bit body adapted to be rotated about a longitudinal axis. The bit body has at least one leg depending from it. The leg terminates in a shirttail portion. The shirttail portion defines a first end face, this first end face having a first circumferential groove defined thereon. The first circumferential groove has a radius which is smaller than a radius of a tip of the shirttail portion. The leg also includes a journal cantilevered from it. A roller cone is rotatably mounted on the journal. The roller cone has a second end face adjacent to the first end face. In one example of this aspect of the invention, the roller cone includes a second circumferential groove on the second end face.

Other aspects and advantages of the invention will be apparent from the following description and the appended claims.

DESCRIPTION OF THE PREFERRED EMBODIMENTS

Figure 1:
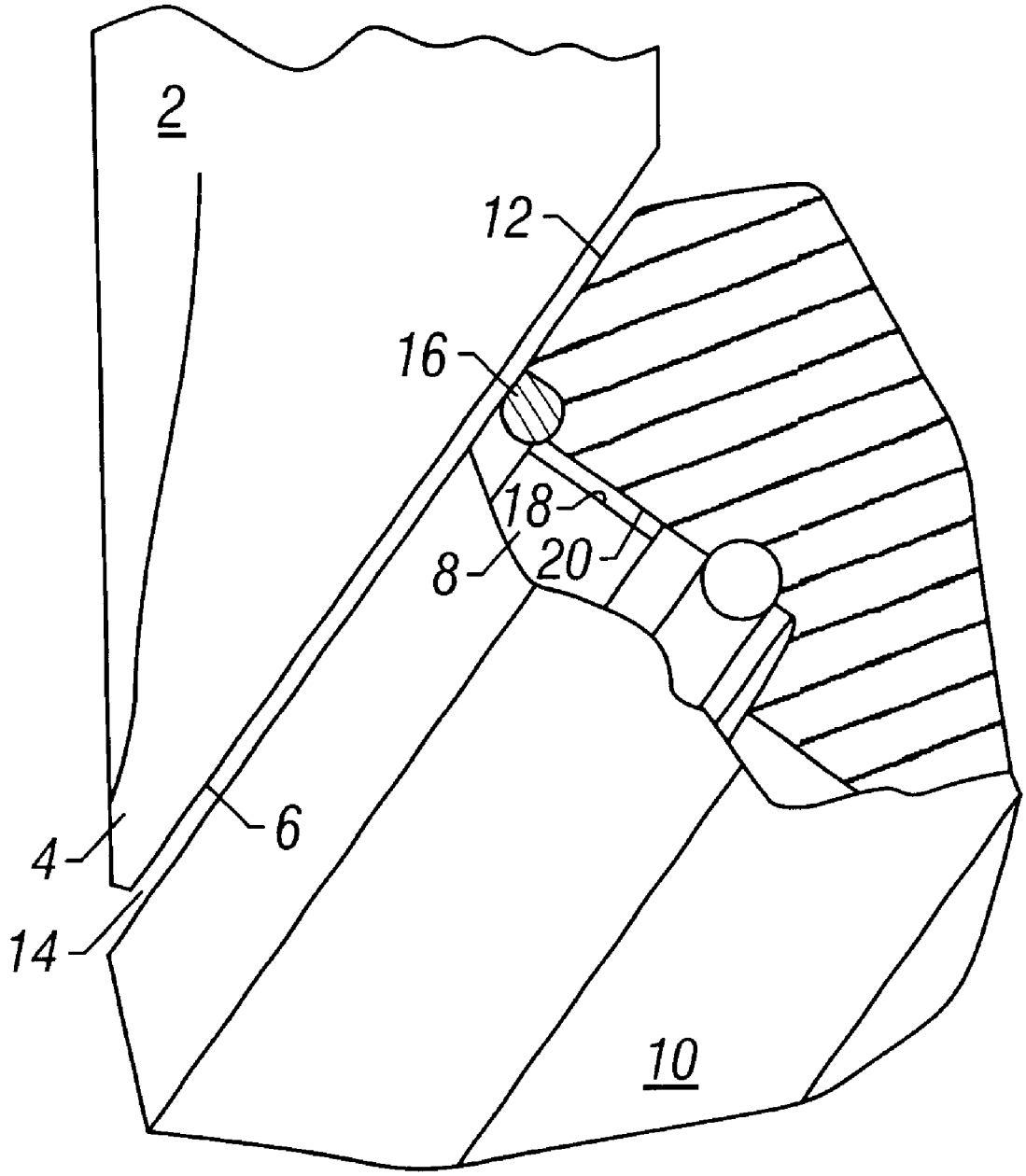
FIG. 1 (Prior Art)
FIG. 1 is a cross section of a prior art drill bit leg.
Figure 2:
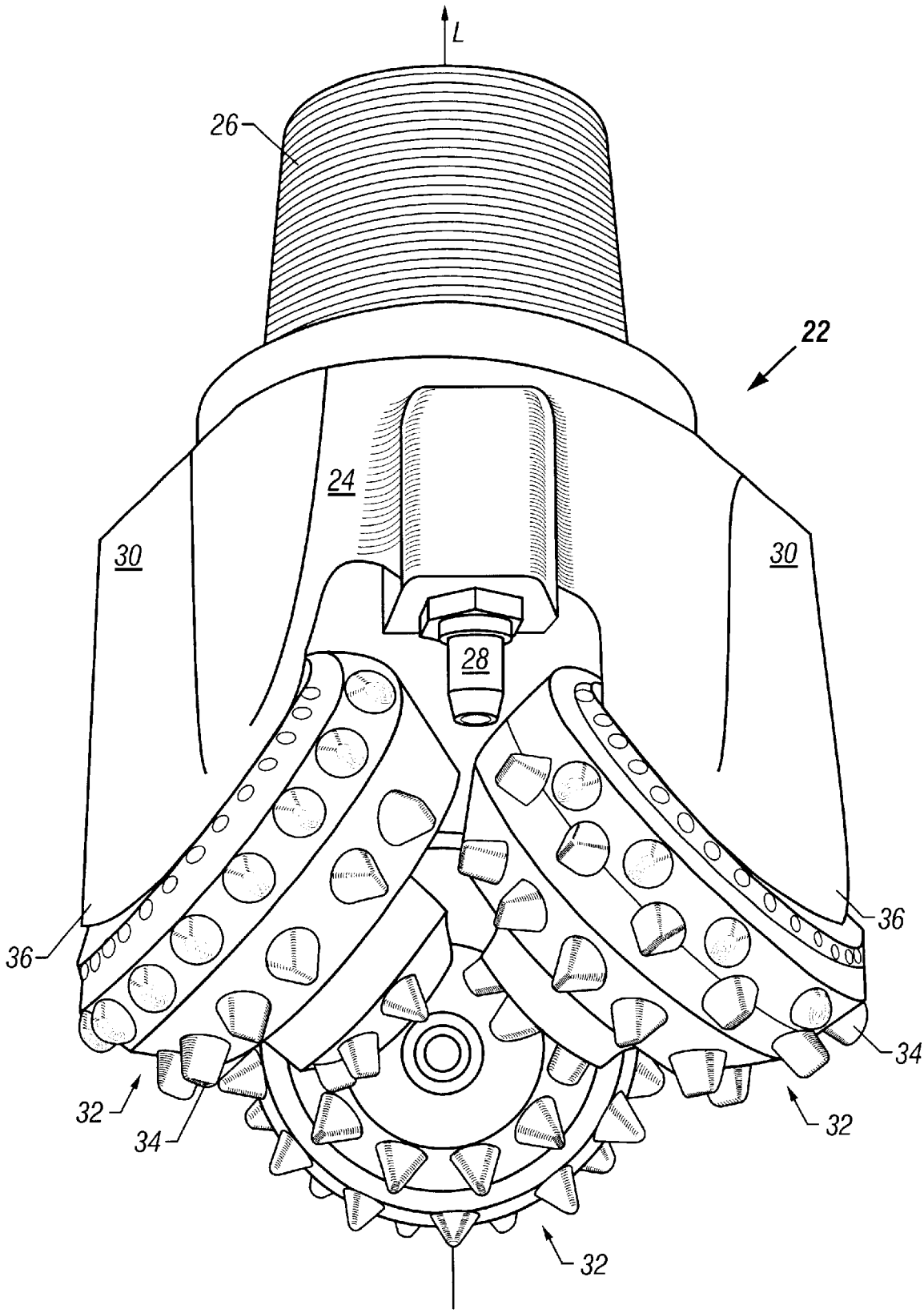
FIG. 2 shows a perspective view of a drill bit.

FIG. 2 shows a roller cone drill bit 22 which comprises a bit body 24 that is adapted to rotate about a longitudinal axis L. The upper end of the bit body 24 includes a threaded pin 26 which can be coupled to another tool, usually a drill string (not shown) to turn the bit 22 to drill earth formations (not shown). Nozzles 28 are provided on the bit body 24 to direct fluid ("drilling mud") received in an internal chamber (not shown) in the bit body 24 to the exterior of the bit body 24. Three legs 30 extend downwardly from the bit body 24. The legs 30 in the bit shown in FIG. 2 are spaced 120 degrees apart along the circumference of the bit body 24. A roller cone 32 is rotatably coupled to each leg 30. The roller cones 32 have cutting elements 34 which cut earth formation as the drill bit 22 is rotated about the longitudinal axis L. Although the drill bit 22 is shown as having three legs 30, it should be clear that the invention is equally applicable to a drill bit having only one leg or any other suitable number of legs. Also, the invention is independent of the type of cutting elements on the roller cones 32.

Figure 3:
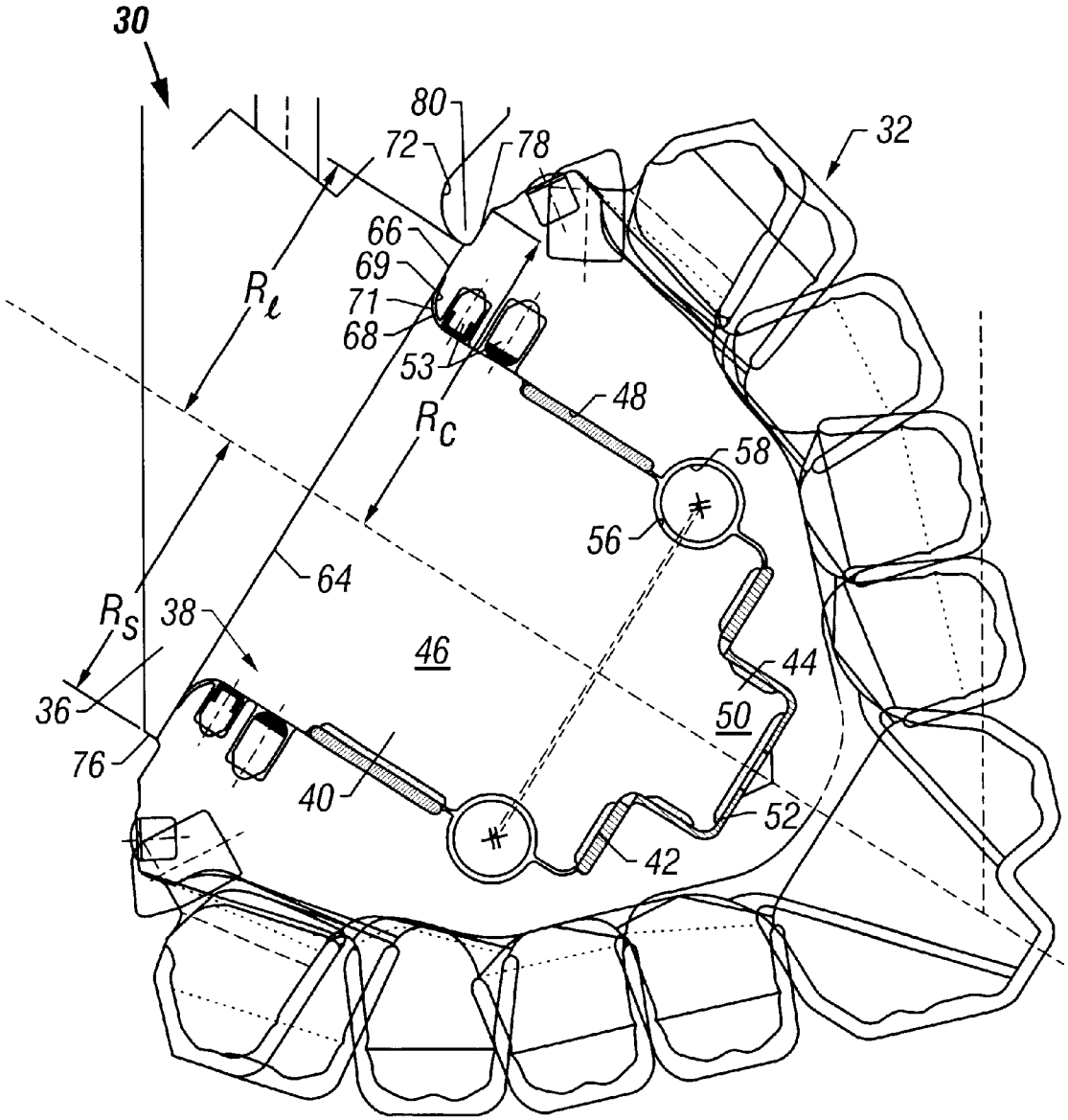
FIG. 3 is a cross section of one of the legs of the drill bit shown in FIG. 2.

Each leg 30 terminates in a substantially circularly-shaped "shirttail" portion 36. FIG. 3 shows the shirttail portion 36 with a bearing pin 38 cantilevered from an end face 64 of the leg 30. The bearing pin 38 includes a journal 40, an axial thrust face 42, and a nose pin 44. The journal 40 forms a main bearing surface 46 for the roller cone 32. The roller cone 32 has a bearing surface 48 which provides a bearing for the main bearing surface 46. The nose pin 44 forms a bearing surface 50 which is retained within a complementary surface 52 within the roller cone 32. Lubricant is fed between the bearing surfaces 46 and 48 through one or more lubrication ports (not shown) in the journal 40 to minimize friction between the bearing surfaces. Friction between the bearing surfaces 46 and 48 may also be minimized by placing a low-friction bearing material, roller bearing, ball bearing, or other anti-friction bearing between the bearing surfaces. Seals 53 are provided to retain the lubricant between the bearing surfaces 46 and 48. However, it should be clear that the invention is not limited to sealed bearing drill bits.

The roller cone 32 is retained on the journal 40 by a ball lock system which includes cone retention balls 54 between ball races 56 and 58 on the bearing surfaces 46 and 48 of the journal 40 and the roller cone 32. The cone retention balls 54 are fed between the ball races 56 and 58 through a ball hole (not shown) that runs from the shirttail portion 36 to the journal 40 and terminates at the ball race 56. The cone retention balls 54 are retained between the ball races 56 and 58 by welding a plug (not shown) in the shirttail side of the ball hole. Other methods of retaining a roller cone on a journal, e.g., segmented cone retention rings disposed in a slot on the journal and subsequently threadedly locked to the roller cone, can also be used with the invention.

When the roller cone 32 is mounted on the journal 40, the end face 66 of the roller cone 32 is adjacent to and generally parallel to the end face 64 of the leg 30. In this example, a clearance 68 is defined between the roller cone 32 and the throat 70 of the leg 30, i.e., the juncture between the leg 30 and the journal 40, to prevent interference between the roller cone 32 and the leg 30 during operation of the drill bit 22. The clearance 68 is defined between two generally parallel surfaces 69 and 71. A substantially circularly-shaped circumferential groove 72 is formed in the end face 64 of the leg 30. The radius $R_l$ of the groove 72 in this example matches the radius $R_s$ of the tip 76 of the shirttail portion 36. A circumferential groove 78 is formed in the end face 66 of the roller cone 32. The radius $R_c$ of the groove 78 on the roller cone 32 in this example matches the radius $R_l$ of the groove 72 on the leg 30. The radii $R_l$, $R_c$, and $R_s$ are measured from the rotational axis R of the roller cone 32.

Figure 4:
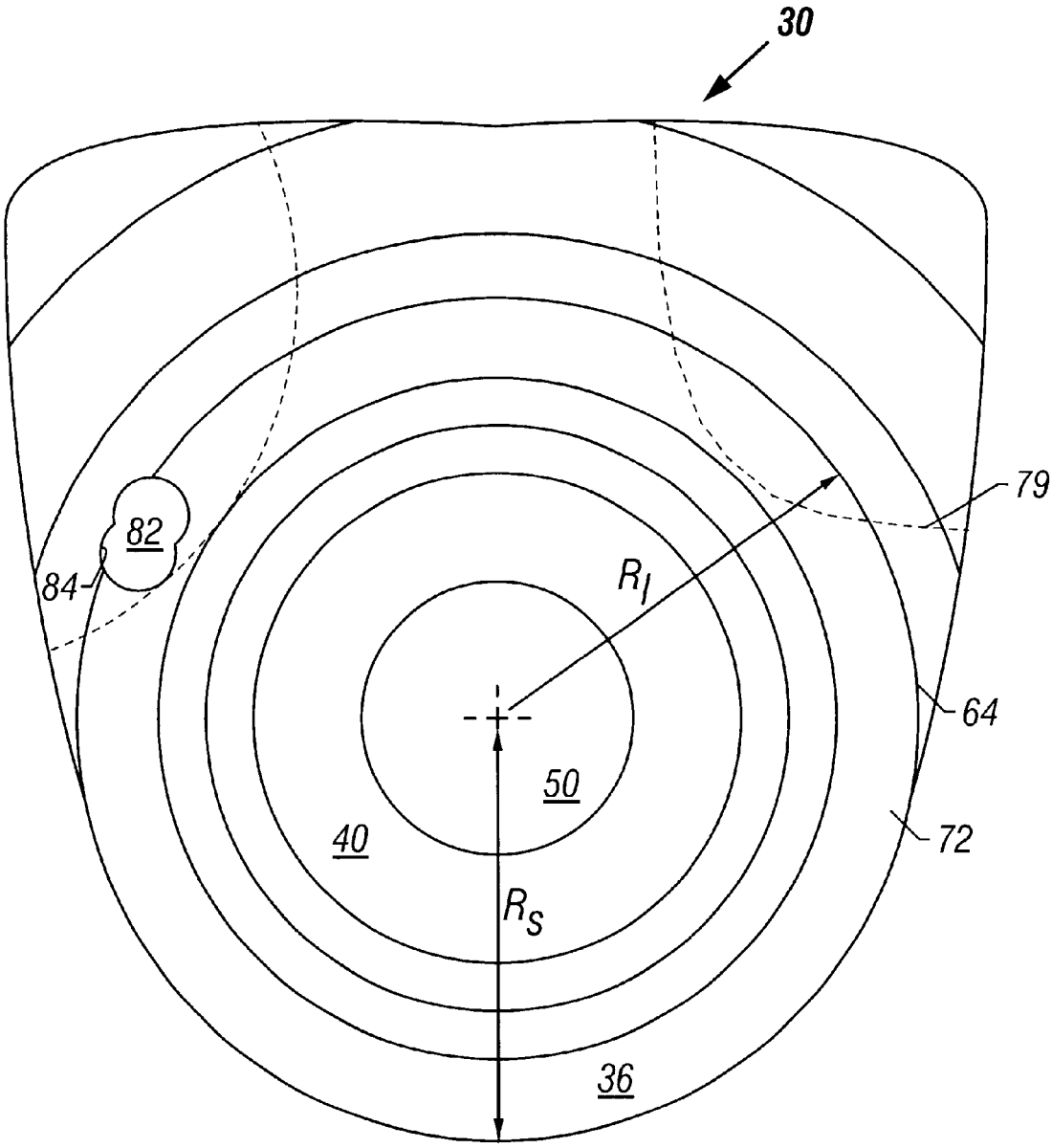
FIG. 4 shows an end view of the leg shown in FIG. 3.
Figure 5:
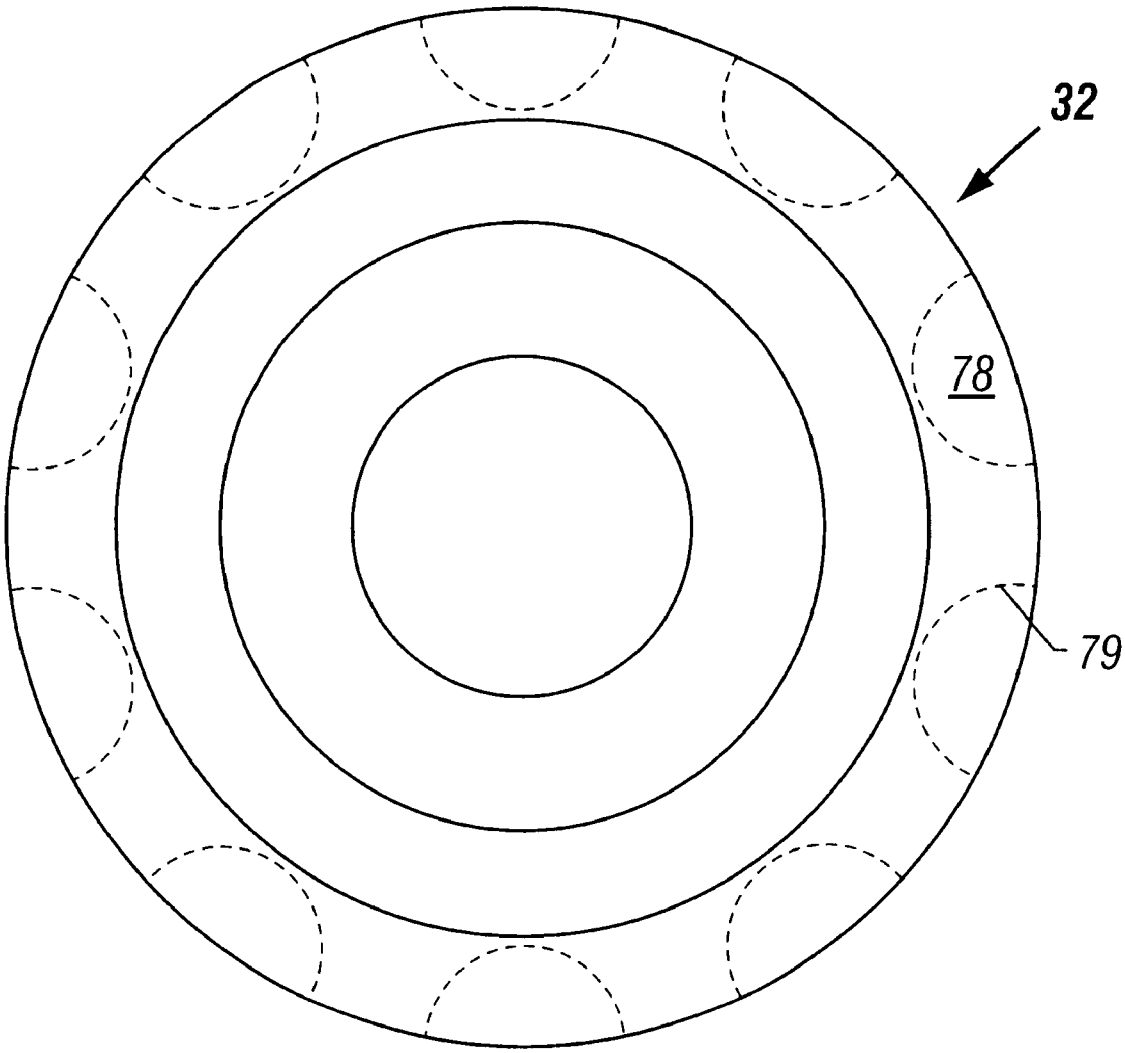
FIG. 5 shows an end view of the roller cone shown in FIG. 3.

FIGS. 4 and 5 show end views of the leg 30 and the roller cone 32, respectively. As shown, and as previously explained, the circumferential grooves 72 and 78 on the leg 30 and on the roller cone 32, respectively, each have a substantially circular profile. However, it should be clear that the circumferential grooves 72 and 78 may also be made of a series of shaped cuts, for example shaped cuts 79, arranged in a substantially circular pattern. It should also be understood that the shirttail portion 36 need not be precisely circular but may instead be formed from a series of flat or other shaped surfaces which in the aggregate approximate a circular profile having the approximate radius $R_s$.

Referring to FIG. 3, the circumferential grooves 72 and 78 form a passage 80 which runs through 360 degrees along the end faces 64 and 66. The passage 80 formed by the matching circumferential grooves 72 and 78 provides a clean path for debris to circulate around the throat 70 during operation of the drill bit, thus eliminating or substantially reducing erosion of the throat 70. Referring to FIG. 4, a burn plug 82 is mounted in an aperture 84 in the end face 64 of the leg 30 to deflect debris away from the clearance 68 (shown in FIG. 3). The burn plug 82 may be completely embedded in the end face 64 or may be flush with the end face 64 or project from the end face 64. Additional burn plugs may be mounted in apertures in the end face 64 of the leg 30, if desired. It should, however, be clear that the invention can be practiced without a burn plug.

The invention is not limited to circumferential grooves of matching radii on adjacent end faces of the leg and the roller cone. FIGS. 6A–7B show other arrangements of grooves that will result in reduction of the erosion of the throat.

Figure 6A:
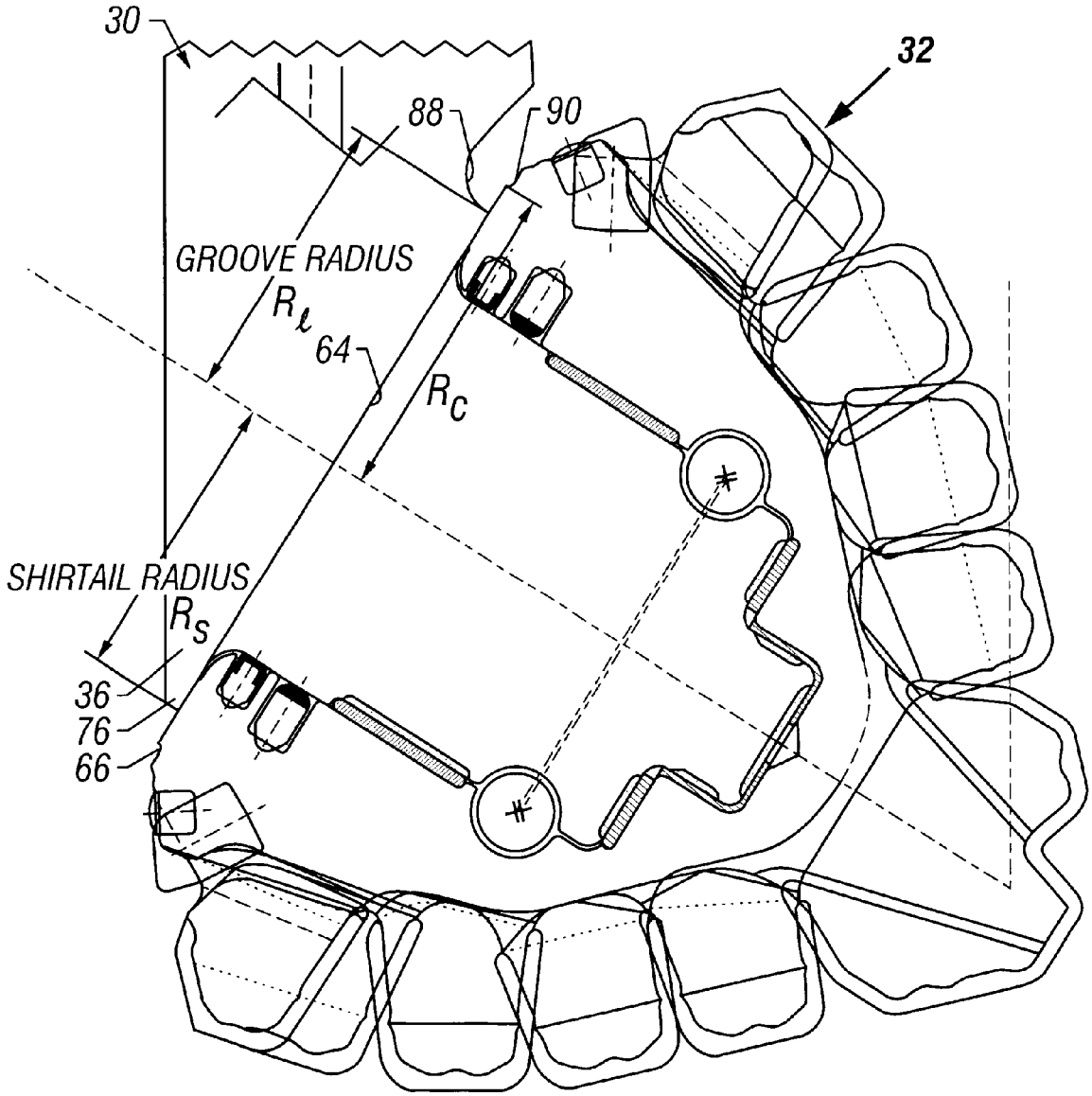
FIGS. 6A–7B show other embodiments of the drill bit leg and the roller cone.
Figure 6B:
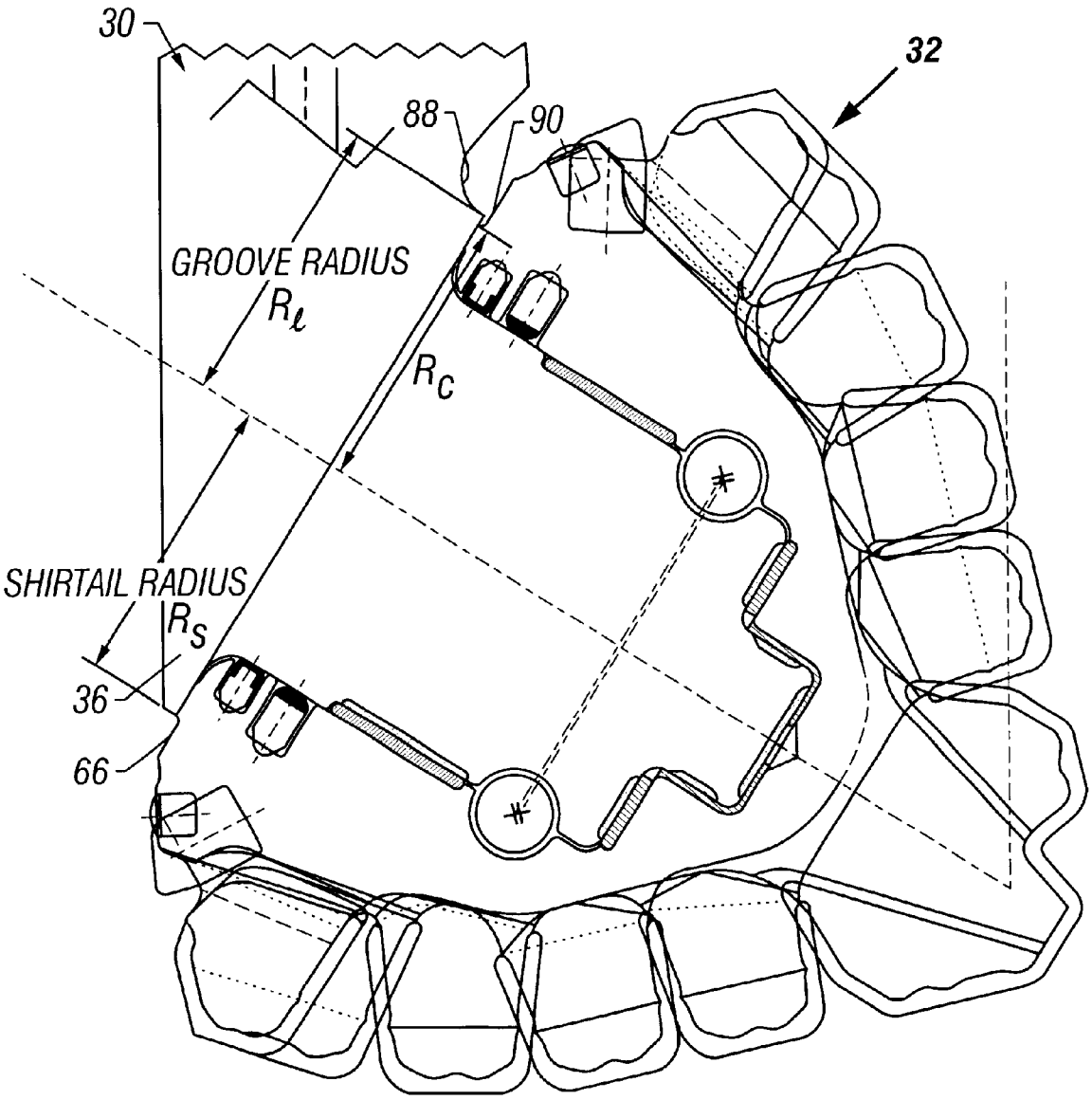

In FIG. 6A, the circumferential grooves 88 and 90 on the end faces 64 and 66 of the leg 30 and the roller cone 32, respectively, have non-matching radii. The radius $R_l$ of the circumferential groove 88 in the end face 64 of the leg 30 is smaller than or equal to the radius $R_s$ of the tip 76 of the shirttail portion 36. The radius $R_c$ of the circumferential groove 90 in the roller cone end face 66 is larger than the radius $R_s$ of the tip 76 of the shirttail portion 36. The radius $R_c$ of the circumferential groove 90 in the roller cone end face could also be smaller than the radius $R_s$ of the tip 76 of the shirttail portion 36, as illustrated in FIG. 6B. The non-matching radii grooves 88 and 90 provide less area for abrasion.

Figure 7A:
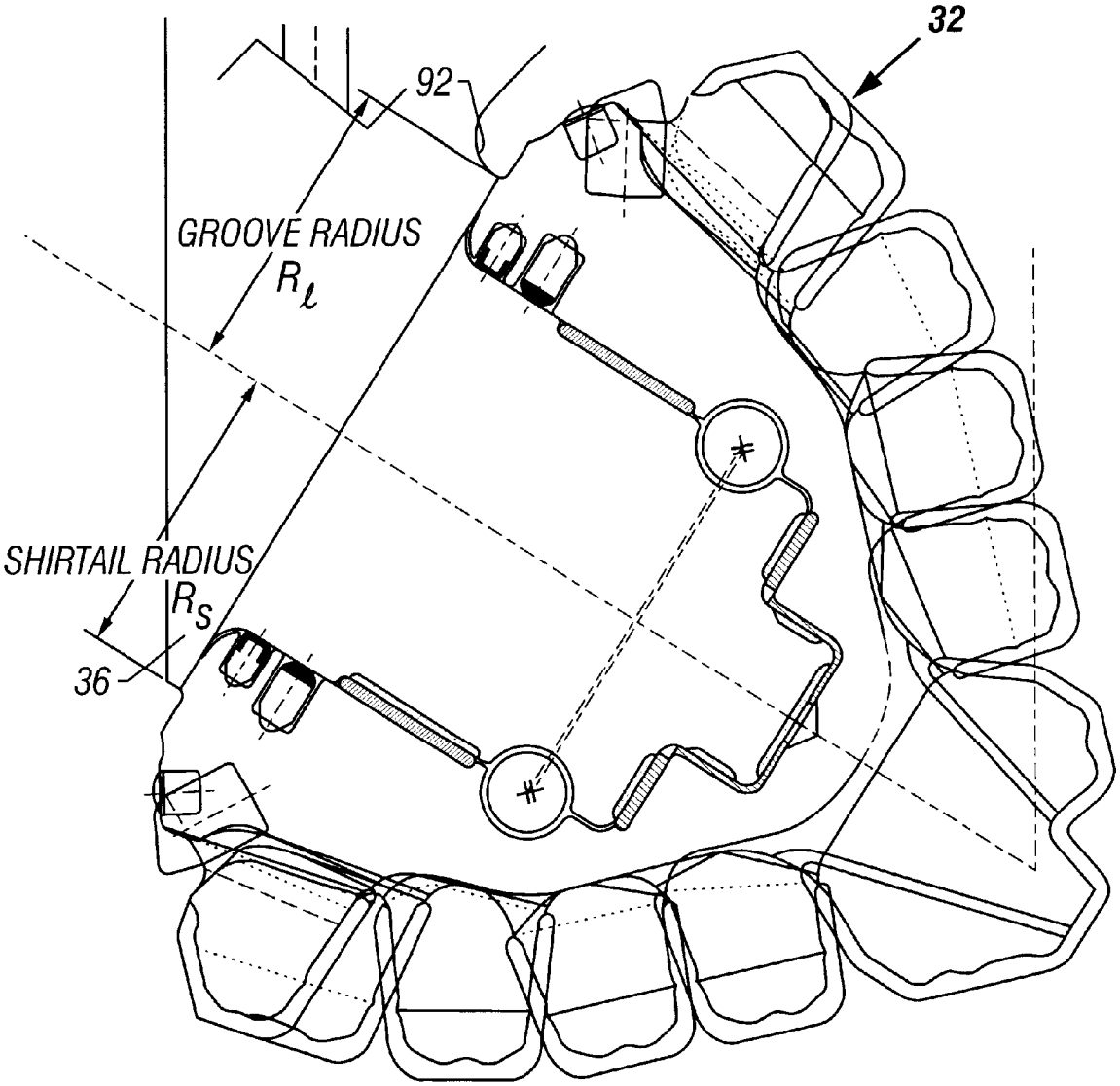
Figure 7B:
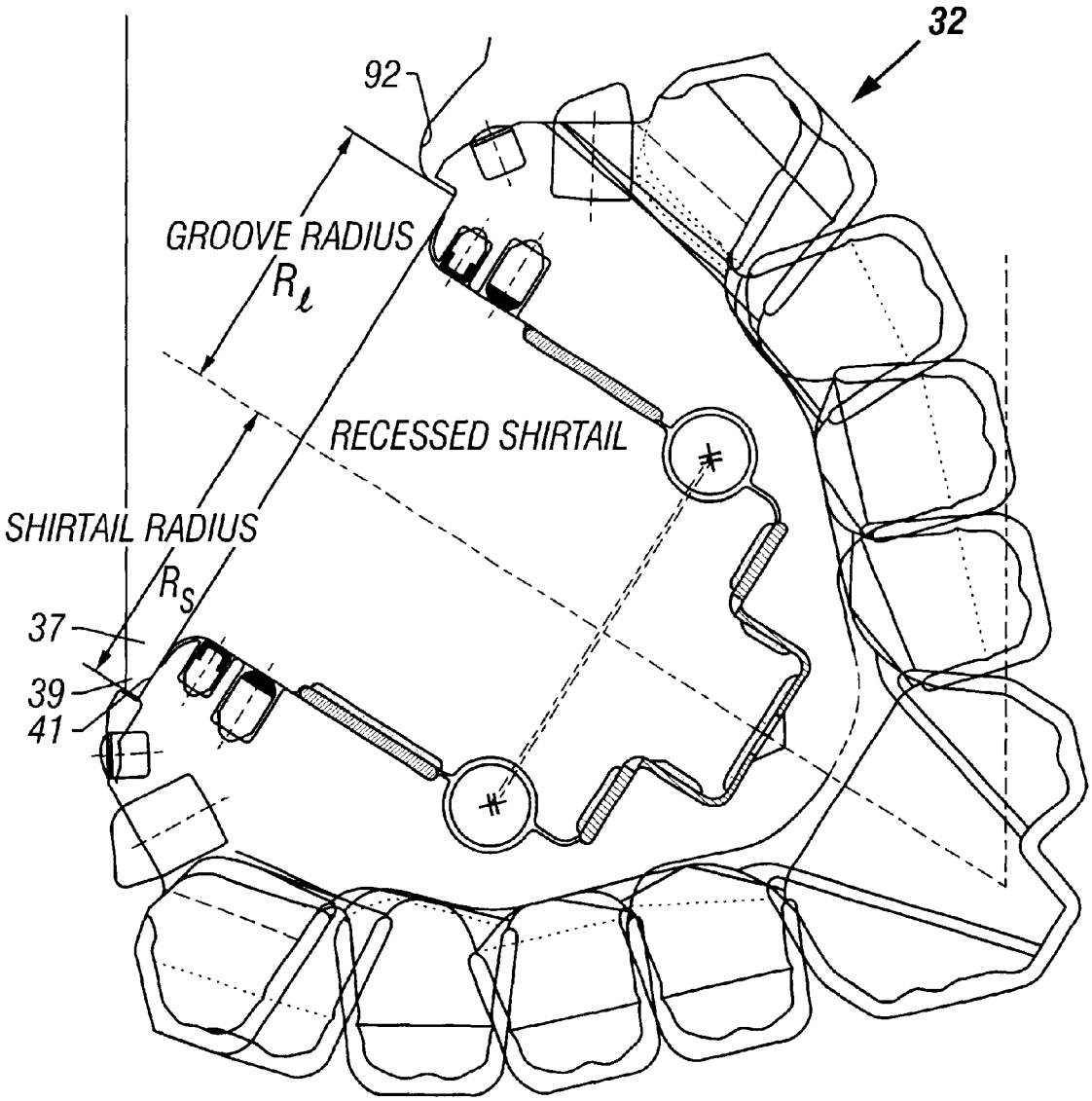
Figure 3:
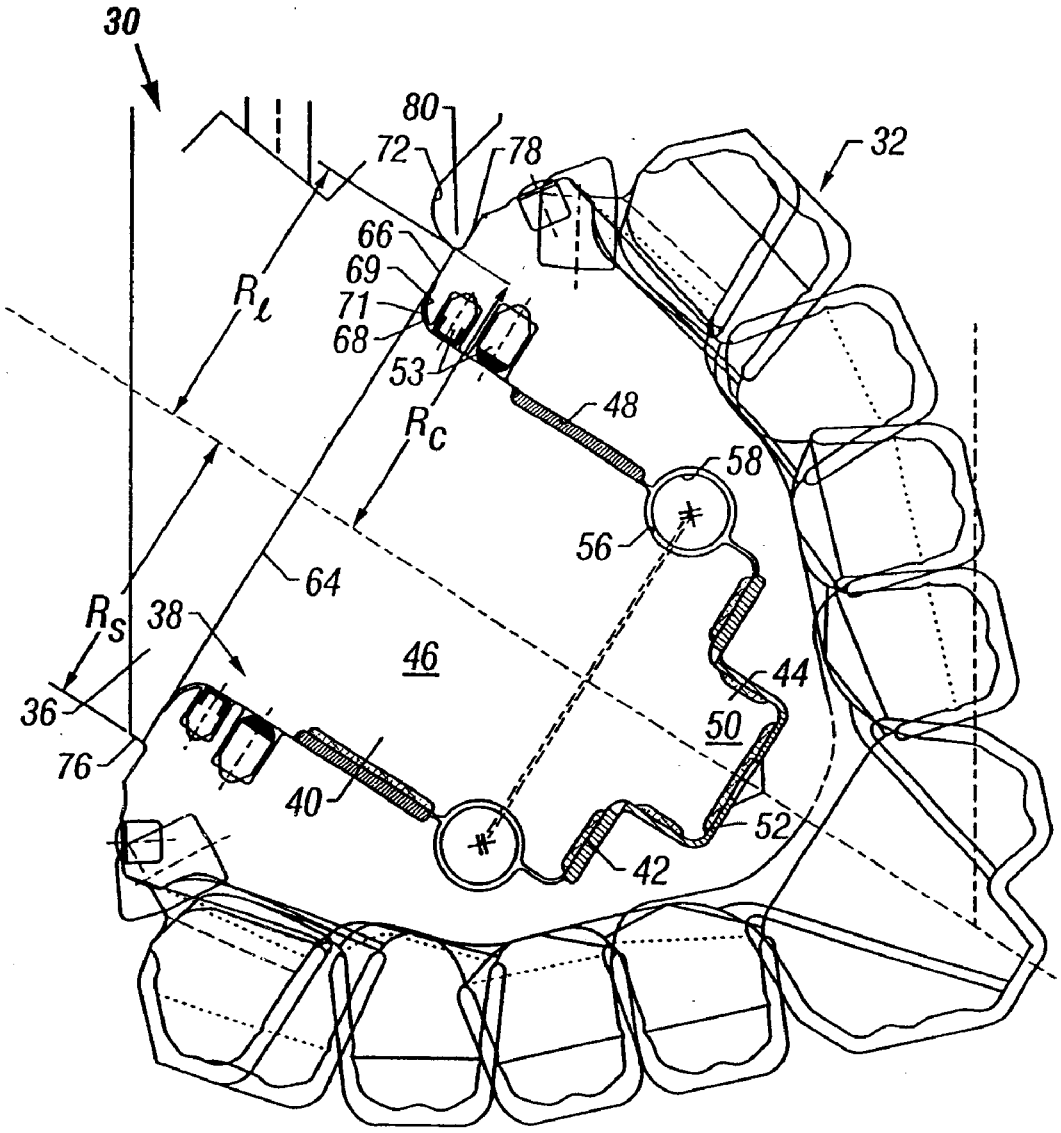

In FIG. 7A, the end face 66 of the roller cone 32 does not have a circumferential groove. However, a circumferential groove 92 having a radius $R_l$ which is smaller than the radius $R_s$ of the tip 76 of the shirttail portion 36 is provided on the end face 64 of the leg 30. The smaller-radius circumferential groove 92 on the end face 64 of the leg 30 compensates for wear in the shirttail tip 76. The circumferential groove 92 may be provided on a non-recessed shirttail, i.e., a shirttail 36 which does not protrude into the roller cone 32, or on a recessed shirttail (shown in FIG. 7B), i.e., a shirttail 37 having a tip 39 protruding into a pocket 41 in the end face 64 the roller cone 32.

Other embodiments of the invention, which do not depart from the spirit of the invention as disclosed herein will be apparent to those skilled in the art to which the invention pertains. Accordingly, the invention shall be limited in scope only by the attached claims.

What is claimed is:

1. A roller cone drill bit comprising:

a bit body adapted to be rotated about a longitudinal axis, the bit body having at least one leg depending therefrom, the leg terminating in a shirttail portion, the shirttail portion defining a first end face, the first end face having a first circumferential groove defined thereon, the first circumferential groove having a radius equal to the radius of a tip of the shirttail portion;

a journal cantilevered from the leg; and a roller cone rotatably mounted on the journal, the roller cone having a second end face adjacent to the first end face and a second circumferential groove defined thereon, wherein the radius of the second circumferential groove is substantially equal to the radius of the tip of the shirttail portion.

2. A roller cone drill bit comprising:

a bit body adapted to be rotated about a longitudinal axis, the bit body having at least one leg depending therefrom, the leg terminating in a shirttail portion, the shirttail portion defining a first end face, the first end face having a first circumferential groove defined thereon;

a journal cantilevered from the leg; and a roller cone rotatably mounted on the journal, the roller cone having a second end face adjacent to the first end face and a second circumferential groove defined thereon;

wherein the first and the second circumferential grooves have substantially equal radii.

3. The roller cone drill bit of claim 2, further comprising a burn plug disposed in an aperture on the first end face to deflect debris away from the circumferential grooves.

4. The roller cone drill bit of claim 2, wherein a tip of the shirttail portion is received in a pocket in the second end face.

5. The roller cone drill bit of claim 2, wherein the radius of the first circumferential groove is smaller than the radius of a tip of the shirttail portion.

6. The roller cone drill bit of claim 2, wherein the radius of the first circumferential groove is larger than the radius of a tip of the shirttail portion.

* * * * *

UNITED STATES PATENT AND TRADEMARK OFFICE

CERTIFICATE OF CORRECTION

PATENT NO. : 6,533,051 B1
DATED : March 18, 2003
INVENTOR(S) : Amardeep Singh et al.

It is certified that error appears in the above-identified patent and that said Letters Patent is hereby corrected as shown below:

Please replace Figure 3 of the drawings with the attached Figure 3.

Signed and Sealed this

Sixth Day of January, 2004

JAMES E. ROGAN
*Director of the United States Patent and Trademark Office*